US007426753B1

(12) United States Patent
Rivers et al.

(10) Patent No.: US 7,426,753 B1
(45) Date of Patent: Sep. 23, 2008

(54) PROTECTIVE GARMENT

(76) Inventors: Paul Brent Rivers, 1886 County Rd. 255, Cullman, AL (US) 35057; Frederick James Diggle, III, 2054-H Vestavia Park Ct., Birmingham, AL (US) 35216

( * ) Notice: Subject to any disclaimer, the term of this patent is extended or adjusted under 35 U.S.C. 154(b) by 648 days.

(21) Appl. No.: 10/663,532

(22) Filed: Sep. 16, 2003

(51) Int. Cl.
*A41D 13/00* (2006.01)

(52) U.S. Cl. ..... 2/2.5

(58) Field of Classification Search ..... 2/2.5, 2/247–253, 92, 94, 69, 102, 108, 16, 115, 2/59, 123–129
See application file for complete search history.

(56) References Cited

U.S. PATENT DOCUMENTS 1,657,866 A * 1/1928 Mooney ..... 2/462
3,500,472 A * 3/1970 Castellani ..... 2/462
3,514,786 A * 6/1970 Terwilliger ..... 2/2.5
4,195,362 A * 4/1980 Rolando ..... 2/461
4,441,211 A * 4/1984 Donzis ..... 2/459
4,507,802 A * 4/1985 Small ..... 2/2.5
5,060,314 A * 10/1991 Lewis ..... 2/2.5
5,210,878 A * 5/1993 Triche ..... 2/16
5,247,707 A * 9/1993 Parker et al. ..... 2/102
5,337,418 A * 8/1994 Kato et al. ..... 2/456
5,495,620 A * 3/1996 Schoenweiss et al. ..... 2/2.5
5,584,737 A * 12/1996 Luhtala ..... 441/107
5,933,865 A * 8/1999 Aldridge ..... 2/81
6,038,700 A * 3/2000 Aldridge et al. ..... 2/81
6,141,800 A * 11/2000 Regan ..... 2/125
6,154,880 A * 12/2000 Bachner, Jr. ..... 2/2.5
6,260,196 B1 * 7/2001 van der Sleesen ..... 2/2.5
6,766,529 B1 * 7/2004 Nathan ..... 2/2.5

* cited by examiner

*Primary Examiner*—Tejash Patel

(57) ABSTRACT

An upper body garment suitable for wearing by a person made of a base fabric and having openings for the person's arms and head, and a breast portion. The garment includes a protective panel attached to the breast portion for protecting the upper body of the person during descent from a vertical surface. A garment suitable for wearing on a lower arm of a person made of a base fabric and having an elongated arm portion, and a hand portion attached to the elongated portion. The garment includes a first protective panel for protecting the upper body portion of the person during descent from a vertical surface.

16 Claims, 3 Drawing Sheets

PROTECTIVE GARMENT

BACKGROUND

The present invention relates generally and in various embodiments to garments. More specifically, the present invention relates generally and in various embodiments to garments worn to protect the wearer from splinters and abrasions resulting from sliding down, for example, a wooden utility pole.

Although various implementations of the present invention, among many, may be described herein with reference to the specific illustrative embodiments related to particular applications, those skilled in the art will understand that the invention is not in any way intended to be, nor should be, limited to such embodiments and/or applications. Those having ordinary skill in the art and reference to the description of the embodiments disclosed and described herein will recognize that additional modifications, applications, and other embodiments may fall within the scope of the claimed invention, and that there may be additional fields in which the present invention may be practiced.

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

Climbing utility structures such as wooden utility poles to a certain height is an essential function of some workers employed by, for example, a telecommunications company. These workers regularly climb wooden utility poles as part of their normal work duty in order to install and repair telephone service, for example. The workers use specialized climbing gear such as gaff hooks attached to their climbing boots to assist them in climbing the wooden utility poles. The gaff hooks are designed to dig into the wood and allow the worker to propel their body straight up in a vertical direction. The gaffs must remain dug into the wood to prevent the worker from falling off the pole. To assist the worker in ascending or descending a pole and to provide a measure of safety, often times they wears a safety belt around their waist attached to their hips and strapped around the pole to assist them in climbing the pole. While ascending a wooden utility pole and working at an elevated environment the worker should generally maintain physical contact with the pole with at least three out of the four limbs (right arm, left arm, right leg and left leg).

Despite the use of specialized climbing equipment such as gaffs, safety belts, and other safety devices, from time-to-time workers lose control of the pole while gaff climbing and begin to descend from the pole. While descending, workers tend to grasp or hug the wooden utility pole.

SUMMARY

In one general respect, embodiments of the present invention are directed to a garment suitable to be worn on an upper body portion of a person. The garment includes a base fabric having a front portion and a rear portion formed with openings for the person's arms and head and having a breast portion on the front portion; and a first protective panel attached to the breast portion of the base fabric; wherein the first protective panel is adapted to protect the upper body portion of the person during descent from a vertical surface.

In one general respect, embodiments of the present invention are directed to a garment suitable to be worn on an upper body portion of a person. The garment includes a base fabric having a front portion and a rear portion formed with openings for the person's arms and head and having a breast portion on the front portion; and a first protective panel attached to the breast portion of the base fabric; wherein the first protective panel is adapted to protect the upper body portion of the person during descent from a vertical surface.

Other apparatuses, systems, and/or methods according to embodiments of the present invention will be or become apparent to one with skill in the art upon examination of the following drawings and detailed description. It is intended that all such additional apparatuses, systems, and/or methods be included within this description, be within the scope of the present invention, and be protected by the accompanying claims.

DESCRIPTION OF THE DRAWINGS

Embodiments of the present invention are described herein in conjunction with the following figures, wherein.

DESCRIPTION

It is to be understood that the figures and descriptions of the various embodiments of present invention described herein, among others, have been simplified to illustrate representative elements of protective garments that may be used when a person descends, for example, a wooden utility pole. The representative elements are relevant for a clear understanding of the present invention, while, for purposes of clarity, other specific elements of the protective garments are not described herein as that would not facilitate a better or clearer understanding of the present invention. Those of ordinary skill in the art will appreciate, however, that these and other elements may be found in conventional garments and may be readily understood.

Figure 1:
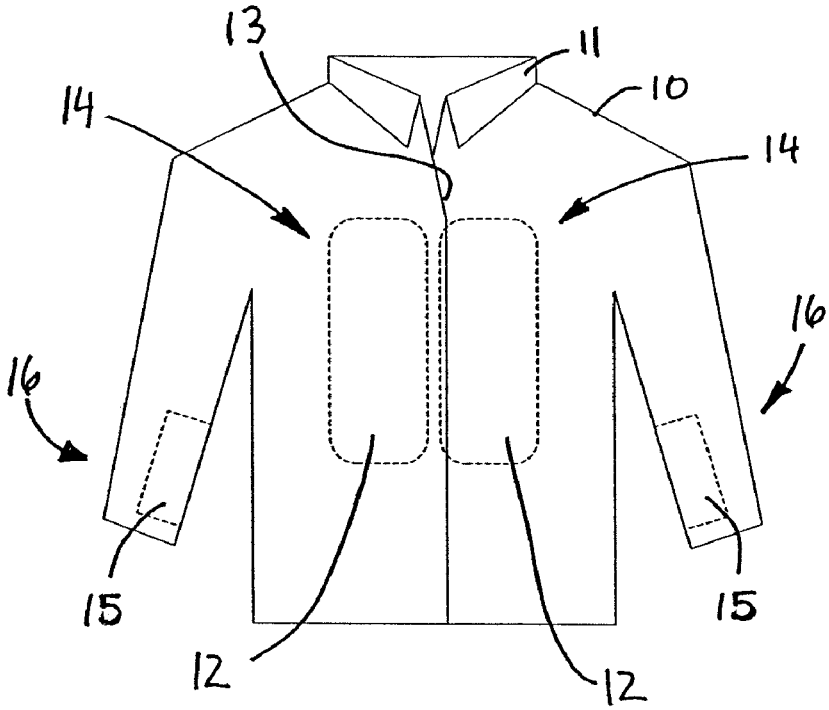
FIG. 1 illustrates a protective garment according to various embodiments of the present invention.
Figure 5:
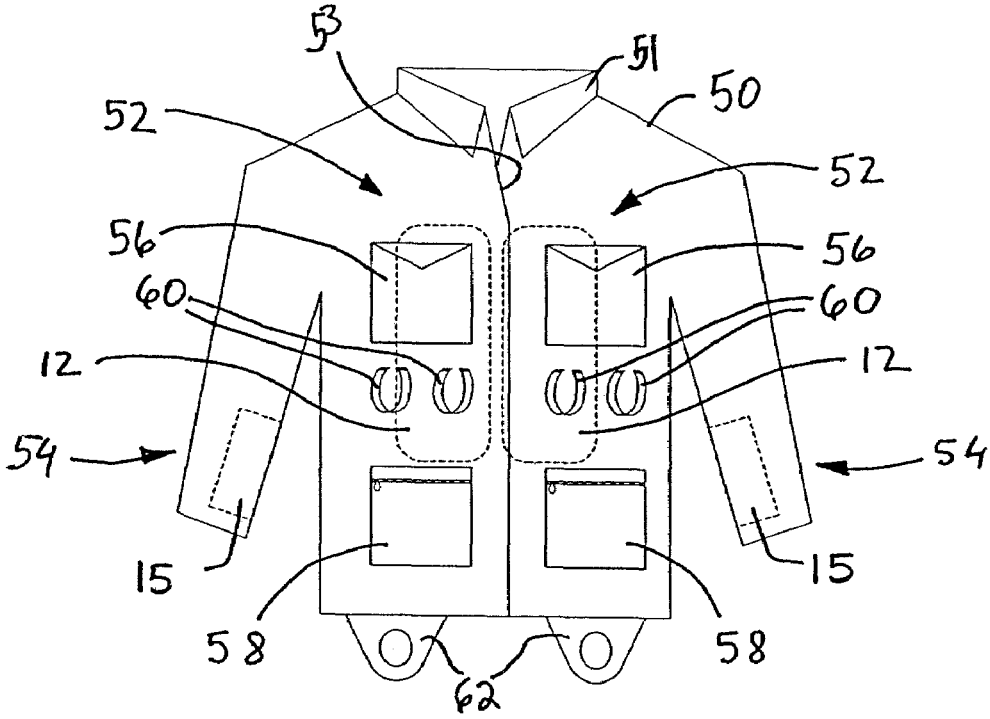
FIG. 5 illustrates another protective garment according to various embodiments of the present invention.

Turning now to FIG. 1, various embodiments of the present invention described herein, among others, are generally directed to a protective garment 10 suitable to be worn on the upper part of a human body. The garment 10 has a collar 11, sleeves 16, and front opening 13. The protective garment 10 may be worn by a person while working in an elevated environment on, for example, a wooden or steel utility pole or other surface or while ascending or descending the surface. The protective garment 10 according to various embodiments of the present invention may comprise lightweight penetration resistant protective panels 12 stitched, sewn, laminated, or otherwise attached to breast portions 14 of the protective garment 10. The protective garment 10 also may comprise forearm portions or sleeves 16 that may include additional similar but separate and distinct lightweight penetration resistant protective panels 15 stitched, sewn, laminated, or otherwise attached to an inner surface of the forearm portion of each sleeve 16. (This is also shown in FIG. 5.) The sleeved protective garment 10 may comprise coats, jackets, shirts, and the like. Each of the protective panels attached to the garment are separate and distinct to provide protection to particular body areas, while allowing for greater mobility of the worker in climbing, descending, and performing detailed maintenance work; as well as greater comfort in various work environments. For example a lightweight base fabric may be used for a garment intended to be worn in warmer weather, where the worker may be working for a prolonged duration out of doors. It will be apparent to a person of ordinary skill in the art that the protective panels 12 and the separate protective panels 15 may be constructed of the same or similar materials, having the same or similar protective properties. References to the materials construction, and protective properties of the protective panels 12 may be equally applied to the protective panels 15 for the purposes of this disclosure.

Figure 2:
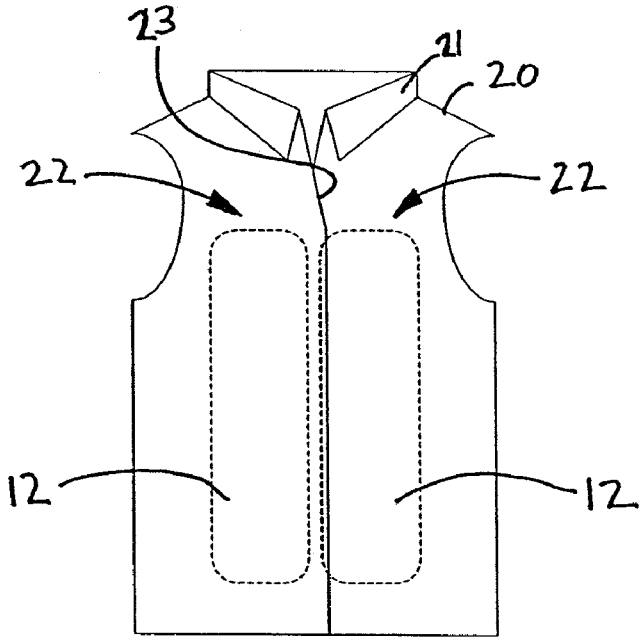
FIG. 2 illustrates another protective garment according to various embodiments of the present invention FIGS. 3A, B illustrate another protective garment according to various embodiments of the present invention.

FIG. 2 illustrates various embodiments of a sleeveless protective garment 20. The protective garment 20 is suitable to be worn on the upper part of a human body and includes a collar 21 and a front opening 23. The sleeveless protective garment 20 also comprises the protective panels 12 in a breast portion 22. The sleeveless protective garment 20 includes vests that may be worn in various types of temperature environments.

In various embodiments of the present invention, the protective garment 10, 20 may be constructed of a flexible base garment comprising the penetration resistant protective panels 12. The protective garment 10, 20 may be constructed of a lightweight, stretchable, breathable, and comfortable fabric to accommodate the environmental conditions encountered by the workers. For example, to accommodate colder working environments the base garment may be constructed of heavier materials such as cotton, wool, polyester/wool blend, polyester/cotton blend and other similar heavier materials. The heavier material also may include some form of heat insulating material. In warmer working environments the protective garment 10, 20 may be constructed of lightweight porous materials. Suitable materials for the base garment may give or stretch to a certain degree to aid in the wearer's comfort.

In various embodiments of the present invention, the protective garments 10, 20 may be formed of a plurality of conventional fibers such as cotton, polyester, nylon, and any blends thereof. The protective garments 10, 20 also may be formed of a lightweight fabric, coated fabric, and/or fabric/laminate that is lightweight, waterproof, windproof, and breathable such as GORE-TEX™ fabric, for example. The protective garments 10, 20 also may comprise a nylon outer shell fabric that is laminated to a waterproof, windproof, breathable membrane such as a GORE-TEX® membrane, for example. The protective garments 10, 20 also may comprise a two-ply nylon shell GORE-TEX® fabric. The protective garments 10, 20 also may comprise lightweight breathable features for higher temperature climates as well as insulated features for colder temperature climates such as a quilted lining with fiberfill insulation, for example. GORE-TEX® is manufactured by W. L. Gore & Associates of Newark, Del.

Figure 3A:
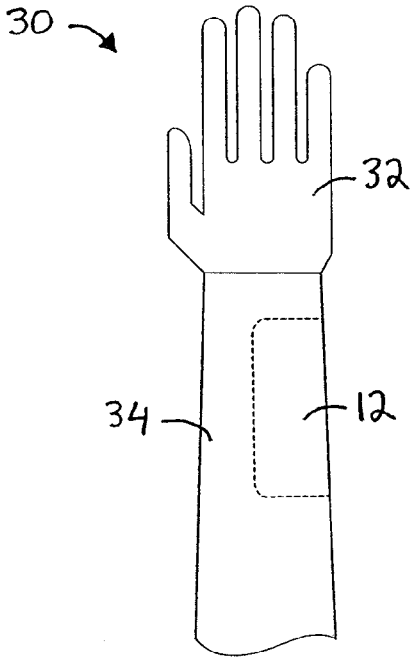

FIG. 3A illustrates various embodiments of a protective garment in the form of a glove 30. The glove 30 includes, for example, a first hand portion 32 comprised of the same protective material that the protective panels 12 are constructed from. The glove 30 also includes a second forearm portion 34 attached to the hand portion 32. The forearm portion 34 also includes a protective panel 12 to protect the wearer from injuries due to splinters and abrasion. The hand portion 32 of the glove 32 may be constructed of a stretchable flexible material while the forearm portion 34 may be constructed of a more durable material.

Figure 3B:
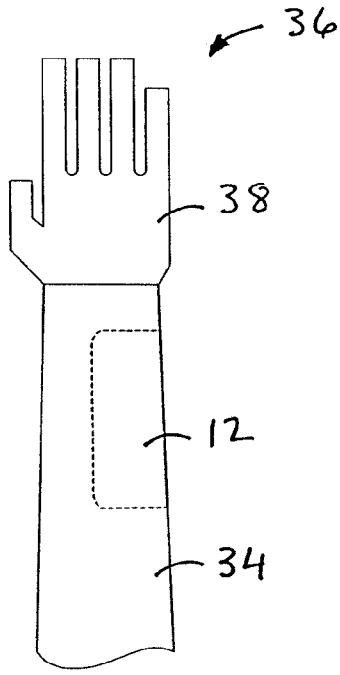

FIG. 3B illustrates another embodiment of a protective garment in the form of a glove 36 with open fingertips for added flexibility, dexterity and to minimize weight and energy retention. The glove 36 also includes, for example, a first hand portion 38 comprised of the same protective material that the protective panels 12 are constructed out of. The glove 36 also includes the forearm portion 34 attached to the hand portion 38. The forearm portion 34 also includes a protective panel 12 to protect the wearer from injuries due to splinters and abrasion. The hand portion 38 of the glove 36 may be constructed of a stretchable flexible material while the forearm portion 34 may be constructed of a more durable material.

In various embodiments of the present invention, the protective panels 12 may be formed of a flexible lightweight heavy-duty penetration resistant material suitable for protecting the wearer against abrasion and splinters while falling from a utility pole with arms around the pole. In various embodiments of the present invention the protective panels 12 may be constructed of a thin, lightweight, low friction, flexible, and smooth material so that they are comfortable to the wearer of the protective garments 10, 20 and do not hinder the wearer's freedom of movement. The protective panels 10, 20 material also may be thin and porous to accommodate workers in higher temperature environments.

Figure 4:
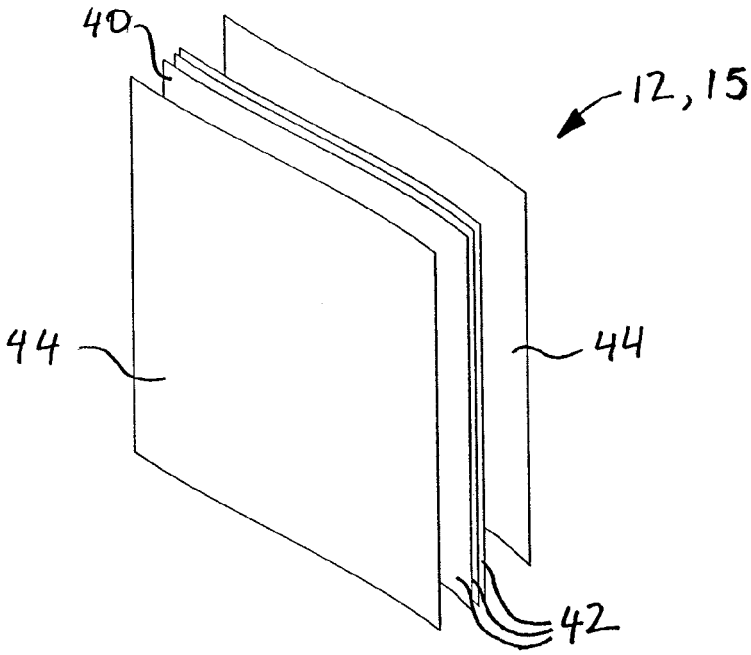
FIG. 4 illustrates a protective panel according to various embodiments of the present invention.

Turning now to FIG. 4, in various embodiments of the present invention the protective panels 10, 20 may be formed of single (mono-layer) or multi-layer high performance natural or synthetic materials that are lightweight, strong, and heat-resistant. For example, the protective panels 12 may be formed using a single ply 40 or multiple plies 42 of fabric woven from any of the aramid high performance fibers listed above. The protective panels 12 may be formed of one to thirty-two plies, for example. In various embodiments of the present invention, the protective panels 12 also may be formed of 3 or 4 plies, for example. Some synthetic aromatic polyamide materials that may be fashioned into high tenacity fibers, filaments, or sheets and used in textiles also may be used to form the protective panels 12. One such class of synthetic fibers that may be suitable for making the protective panels 12 is commonly referred to as aramid fiber. Fabrics made from high performance aramid fibers may be suitable for fashioning the protective panels 12 that are splinter and abrasion resistant. There are many commercially available high performance aramid fibers that may be used to weave fabrics suitable for making splinter and abrasion resistant protective panels 12. Any type of fiber, including those not mentioned herein, may be used to make the protective panels 12 according to various embodiments of the present invention. As discussed previously, the protective panels 12, whether formed of the single ply layer 40 or the multiple plies 42, may be attached to a base fabric 44 of which the protective garments 10, 20 are constructed. The individual single ply layers 40 or the multiple plies 42 fabric may be attached to each other by, for example, laminating, stitching, sewing, and other suitable means of attachment. The protective panels 12 also may be stitched, sewn, laminated, or attached to the base fabric 44 using any suitable means.

As discussed previously, the base fabric 44 may be formed of a plurality of conventional fibers such as cotton, polyester, nylon, and any blends thereof. The base fabric 44 also may be formed of a lightweight fabric, coated fabric, and/or fabric/laminate that is lightweight, waterproof, windproof, and breathable such as GORE-TEX® fabric, for example. Base fabric 44 also may comprise a nylon outer shell fabric that is laminated to a waterproof, windproof, breathable membrane such as a GORE-TEX® membrane, for example. The base fabric 44 also may comprise a two-ply nylon shell GORE-TEX® fabric.

Examples of high performance aramid fibers that may be suitable for weaving fabrics for making the protective panels 12 include, but are not limited to Kevlar®, an organic fiber produced by the DuPont Corporation of Wilmington, Del., which is a light structural fiber that provides impact resistance. One type of Kevlar® fabric that may be suitable for constructing the protective panels 12 according to one of many embodiments of the present invention includes a style 779 aramid high performance fabric available from Hexcel Schwebel of Stamford, Conn. The 779 aramid fabric comprises a Kevlar® 159 yarn that is 200 denier mesh. The fabric weighs 3.9 oz/yd$^2$ and is of plain weave style. The nominal construction of the style 779 fabric comprises a warp count and fill count of 70 yarns/inch. The fabric may have a thickness of 6.0 to 8.0 mils, a breaking strength of 385 lbf/in and is suitable for safety and personal protection applications. The Kevlar® protective panels 12 will not burn although they may melt at 900° F. Also, the Kevlar® protective panels 12 may be treated to make them water repellant.

The protective panels 12 also may be made from fabrics woven from other fibers such as, for example, Twaron®, a high strength fiber made from aramid polymer supplied by Accordis of Arnhem, The Netherlands. This fiber is similar to Kevlar® and is a useful material for reinforcement and splinter and abrasion resistance applications. Yet another fiber that may be used to weave fabrics for making the protective panels 12 includes Spectra®, which is an ultra lightweight, high strength polyethylene fiber developed by Honeywell International Corporation of Morristown, N.J. Spectra® fibers provide high damage tolerance and flexibility. Another fiber that may be used to weave the fabric to make the panels is Zylon®, which consists of a rigid chain of molecules of ploy (p-phenylene-2,6-benzobisoxazole) (PBO). This fiber is available from Toyobo of Osaka, Japan.

FIG. 5 illustrates various embodiments of a protective garment 50 suitable to be worn on the upper part of a human body having a collar 51, sleeves 54, and front opening 53. The protective garment 50 includes the protective panels 12 in a breast portion 52 as well as the sleeves 54. The protective garment 50 also includes a variety of pockets 56, 58 designed to hold items that may be useful to a worker while working in elevated environments such as up on a utility pole. The protective garment 50 also includes carry loops 60 that may be useful for carrying additional tools up on the utility pole. The variety of useful items may include, for example, wire connectors, wire, tone probe, pullers, and safety related items and equipment. The pockets 56, 58 and loops 60 also may be useful for carrying hardware such as "J" and "P" hooks, hammers, powder drivers, meters, small blocks, cable clamps, drop wire clamps, strand connectors, dead end wire, earmuffs, flashlights, safety and sunglasses, gloves, hat liners, nut drivers, bridle rings, tags, and screws. The protective garment 50 also includes attachable and detachable structural members 62 that are designed to secure the bottom of the protective garment 50 to the worker's climbing safety belt to minimize the likelihood of the protective panels 12 rising up the worker's body while descending and hugging a pole. The attachable and detachable structural members 62 may include for example loops, buttons, snaps hooks, and hook and loop fasteners such as Velcro®, for example, and other suitable means for attaching and detaching the protective garment 50 to the safety belt.

Figure 6:
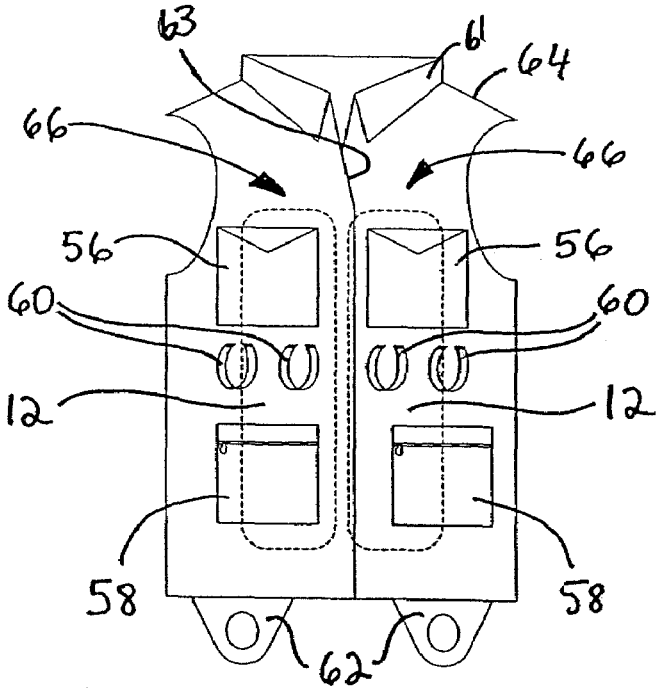
FIG. 6 illustrates another protective garment according to various embodiments of the present invention.

FIG. 6 illustrates various embodiments of a sleeveless protective garment 64 that is similar to the protective garment 50 shown in FIG. 5 except for the sleeves. The protective garment 64 may be suitable to be worn on the upper part of a human body and may include a collar 61 and a front opening 63. The sleeveless protective garment 64 also comprises the protective panels 12 in a breast portion 66. The sleeveless protective garment 64 may include vests that may be worn in various types of temperature environments. The sleeveless protective garment 64 also may include a variety of pockets 56, 58 and loops 60 for carrying useful items and also includes the attachable and detachable structural members 62 to secure the bottom of the protective garment 60 to the worker's climbing safety belt.

Although the present invention has been described with regard to certain embodiments, those of ordinary skill in the art will recognize that many modifications and variations of the present invention may be implemented. The foregoing description and the following claims are intended to cover all such modifications and variations. Furthermore, the components and processes disclosed are illustrative, but are not exhaustive. Other components and processes also may be used to make systems and methods embodying the present invention.

The invention claimed is:

1. A garment suitable to be worn on an upper body portion of a person, consisting essentially of:

a base fabric having a front portion and a rear portion, formed with openings for arms and head of the person, the front portion having a breast portion, and a portion that is not the breast portion;

a first protective panel attached to the breast portion of the base fabric, but not attached to the front portion that is not the breast portion of the base fabric;

a second protective panel attached to the breast portion of the base fabric, but not attached to the front portion that is not the breast portion of the base fabric; and a pair of sleeves attached to the base fabric for receiving the person's arms, each sleeve having an upper-arm portion and a forearm portion, and each sleeve having a third protective panel attached to an inner forearm surface of the forearm portion and not the upper-arm portion of each sleeve, wherein the third protective panel extends approximately half of a way around a perimeter of the forearm portion of each sleeve, and is positioned proximate to a wrist opening on the sleeve, wherein the first and second protective panels are positioned in a non-overlapping configuration, wherein the first and second protective panels are adapted to protect the upper body portion of the person during descent from a vertical surface, wherein each of the first and second protective panels comprises a substantially rectangular panel, wherein the first protective panel is positioned on a right side of the breast portion and proximate to a center of the garment, and the second protective panel is positioned on a left side of the breast portion and proximate to the center of the garment, wherein each of the first, second and third protective panels are separate and distinct panels, remote from each other, and wherein each of the first, second and third protective panels are comprised of aramid fiber.

2. The garment of claim 1, further comprising a collar portion.

3. The garment of claim 1, further comprising at least one of pockets and loops on the front portion of the base fabric.

4. The garment of claim 1, further comprising attachable and detachable structural members adapted to secure the bottom of the garment to a safety belt.

5. The garment of claim 4, wherein the attachable and detachable structural members are selected from the group consisting of loops, buttons, snaps, hooks, and loop fasteners.

6. The garment of claim 1, wherein the base fabric is formed into any one of a coat, jacket, shirt, and vest.

7. The garment of claim 1, wherein the protective panel comprises at least one ply of a fabric formed of aramid fibers.

8. The garment of claim 7, wherein the aramid fibers are selected from the group consisting of Kevlar® fiber, Twaron® fiber, Spectra® fiber, and Zylon® fiber.

9. The garment of claim 7, wherein the protective panel fabric is constructed from aramid fiber of 200 denier mesh.

10. The garment of claim 7, wherein the protective panel fabric is constructed from aramid fiber having a weight of 3.9 oz/yd2.

11. The garment of claim 7, wherein the protective panel fabric is constructed from aramid fiber having a warp count of 70 yarns/inch.

12. The garment of claim 7, wherein the protective panel fabric is constructed from aramid fiber having a fill count of 70 yarns/inch.

13. The garment of claim 7, wherein the protective panel fabric is constructed from aramid fiber having a thickness from 6 to 8 mils.

14. The garment of claim 7, wherein the protective panel fabric is constructed from aramid fiber having a breaking strength of 385 lbf/inch.

15. A garment suitable to be worn on an upper body portion of a person, consisting essentially of:

a base fabric having a front portion and a rear portion, formed with openings for arms and head of the person, the front portion having a breast portion, and a portion that is not the breast portion;

a first protective panel attached to the breast portion of the base fabric, but not attached to the front portion that is not the breast portion of the base fabric;

a second protective panel attached to the breast portion of the base fabric, but not attached to the front portion that is not the breast portion of the base fabric;

a collar portion formed around the opening for the head;

a pair of sleeves attached to the base fabric for receiving the person's arms, each sleeve having an upper-arm portion and a forearm portion;

a third protective panel attached to an inner surface of the forearm portion of each sleeve, and not the upper-arm portion of each sleeve, wherein the third protective panel extends approximately half of a way around a perimeter of the forearm portion of each sleeve and is positioned proximate to a wrist opening on each sleeve;

at least one of pockets and loops attached to the front portion of the base fabric;

attachable and detachable structural members adapted to secure the bottom of the garment to a safety belt;

wherein each of the first and second protective panels comprises a substantially rectangular panel, wherein the first protective panel is positioned on a right side of the breast portion proximate to a center of the garment and the second protective panel is positioned on a left side of the breast portion proximate to a center of the garment, wherein each of the first, second and third protective panels are separate and distinct panels, remote from each other, wherein each of the first, second and third protective panels are comprised of aramid fiber, wherein the first and second protective panels are positioned in a non-overlapping configuration, and wherein the first and second protective panels are adapted to protect the upper body portion of the person during descent from a vertical surface.

16. A garment suitable to be worn on an upper body portion of a person, consisting essentially of:

a base fabric having a front portion and a rear portion, formed with openings for arms and head of the person, and having a breast portion on the front portion, and a portion that is not the breast portion on the front portion;

at least one of pockets and loops attached to the front portion of the base fabric;

a first protective panel attached to the breast portion of the base fabric, but not attached to the front portion that is not the breast portion of the base fabric; and a second protective panel attached to the breast portion of the base fabric, but not attached to the front portion that is not the breast portion of the base fabric, wherein the first and second protective panels are positioned in a non-overlapping configuration, wherein the first and second protective panels are adapted to protect the upper body portion of the person during descent from a vertical surface, wherein each of the first and second protective panels comprises a substantially rectangular panel, wherein each of the first, second and third protective panels are separate and distinct panels, remote from each other, wherein the first protective panel is positioned on a right side of the breast portion proximate to a center of the garment and the second protective panel is positioned on a left side of the breast portion proximate to a center of the garment, and wherein each of the first, second and third protective panels comprise aramid fiber.

* * * * *